US011800932B1

(12) United States Patent
Olarte

(10) Patent No.: US 11,800,932 B1
(45) **Date of Patent: *Oct. 31, 2023**

(54) CHAIR WITH MOLDED PANEL

(71) Applicant: Series International, LLC, Aventura, FL (US)

(72) Inventor: Alvaro Mauricio Olarte, Aventura, FL (US)

(73) Assignee: Series International, LLC, Aventura, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/900,532

(22) Filed: Aug. 31, 2022

Related U.S. Application Data

(63) Continuation-in-part of application No. 17/718,988, filed on Apr. 12, 2022, now Pat. No. 11,464,337.

(51) Int. Cl.

| | |
|---|---|
| ***A47C 1/121*** | (2006.01) |
| ***A47C 4/06*** | (2006.01) |
| ***A47C 7/16*** | (2006.01) |
| ***A47C 7/24*** | (2006.01) |
| ***A47C 7/18*** | (2006.01) |

(52) U.S. Cl.
CPC ..... *A47C 7/185* (2013.01); *A47C 1/121* (2013.01)

(58) Field of Classification Search
CPC .... A47C 3/04; A47C 3/12; A47C 4/06; A47C 4/30; A47C 5/12; A47C 7/16; A47C 7/18; A47C 7/24; A47C 7/282; A47C 1/121
USPC ..... 297/452.12, 452.13, 452.14, 452.2, 297/452.55, 452.56
See application file for complete search history.

(56) References Cited

U.S. PATENT DOCUMENTS

| | | | |
|---|---|---|---|
| 3,647,260 | A | 3/1972 | Grant et al. |
| 3,722,950 | A | 3/1973 | Harnick |
| 4,761,035 | A | 8/1988 | Urai |
| 4,900,085 | A | 2/1990 | Tobler |
| 5,375,914 | A | 12/1994 | Donnelly |
| 5,704,691 | A | 1/1998 | Olson |
| 6,220,661 | B1 | 4/2001 | Peterson |
| 6,409,267 | B1 | 6/2002 | Pietrzak |
| 6,582,020 | B1 | 6/2003 | Tenenboym et al. |
| 6,612,652 | B1 | 9/2003 | Tenenboym et al. |
| 7,490,392 | B2 | 2/2009 | Peterson |
| 7,690,732 | B2 | 4/2010 | Olarte |
| 8,727,445 | B2 | 5/2014 | De Maina |
| 8,973,990 | B2 | 3/2015 | Krupiczewicz et al. |
| 9,565,949 | B2 | 2/2017 | Peterson |

(Continued)

FOREIGN PATENT DOCUMENTS

GB 1133972 A 11/1968

*Primary Examiner* — Rodney B White
(74) *Attorney, Agent, or Firm* — ST. ONGE STEWARD JOHNSTON AND REENS

(57) ABSTRACT

A chair is provided with a seat support frame which may be comprised of at least two tubes spaced apart by a polymer connector. The seat support frame supports a foam cushion and the frame may be embedded in the foam and may include flexible supports across the support frame also embedded in the foam. A rigid panel has a cavity and the rigid panel is arranged adjacent an outer surface of said foam cushion with at least part of said foam cushion positioned within the cavity, wherein said rigid panel is affixed to said support frame and an inner surface of said rigid panel faces the outer surface of said foam cushion.

23 Claims, 11 Drawing Sheets

(56) References Cited

U.S. PATENT DOCUMENTS

| | | | | |
|---|---|---|---|---|
| 9,693,631 | B2 | 7/2017 | Jacobs et al. | |
| 10,555,610 | B2 | 2/2020 | Jacobs et al. | |
| 10,588,414 | B2 | 3/2020 | Olarte | |
| 11,464,337 | B1 * | 10/2022 | Olarte | A47C 7/16 |
| 2002/0038970 | A1 | 4/2002 | Leng et al. | |
| 2003/0102703 | A1 | 6/2003 | Tenenboym et al. | |
| 2005/0017554 | A1 | 1/2005 | Mizelle et al. | |
| 2005/0194829 | A1 | 9/2005 | Aerts | |
| 2005/0242651 | A1 | 11/2005 | Peitz et al. | |
| 2008/0036266 | A1 | 2/2008 | Battey et al. | |
| 2012/0228918 | A1 | 9/2012 | Takahashi et al. | |
| 2015/0021964 | A1 | 1/2015 | Jacobs et al. | |
| 2017/0164746 | A1 | 6/2017 | Phillips | |
| 2018/0098634 | A1 | 4/2018 | Smith et al. | |
| 2021/0052077 | A1 | 2/2021 | Smith et al. | |

* cited by examiner

CHAIR WITH MOLDED PANEL

FIELD OF THE INVENTION

The following invention relates to seating and in certain embodiments to seating designed for theaters, auditoriums, meeting rooms, event spaces and/or lecture rooms/halls. In some cases these seats are "fixed" in that they are bolted or otherwise secured to the floor they rest on.

BACKGROUND OF THE INVENTION

One of the challenges with large seating projects is that each designer or architect will want different design features, depending on the budget and room design. As a result, many large orders of seats involve a seat being semi-custom designed and then manufactured based on the volume of seats for a particular job.

As a result, each seat with different options will often share some component compatibility, but not others. For example, seats with a wood back or a plastic back or upholstered back often each require different back support pieces which are generally not interchangeable. Similar issues exist with a number of other components. This creates parts inventory increases and customization increases which leads to increased cost in that a high end wood panel back and seat chair involves a very different process than a less expensive plastic backed chair.

Furthermore, while some situations it may be desirable to have an upholstered rear of the back and/or bottom of the seat, these areas can be subject to wear and tear. The solution is often to provide a slab foam cushion with upholstery on top of a wood or plastic support structure. As a result, the seat or backrest surface is cushioned and upholstered whereas the opposite surface (rear surface of backrest, bottom surface of seat) is made of a more durable material. However, the downside of this is that the more comfortable webbing and injection molded foam cannot be used as the whole purpose of that design is to allow the bottom of the seat to flex down to provide added comfort in less thickness. The hard wood or plastic support would detract from this comfort or alternately will require much more foam, which is more expensive and increases the chair envelope—a feature that can be undesirable given fire code restrictions and free space egress requirements for long rows of chairs in large auditoriums.

SUMMARY OF THE INVENTION

It is therefore an object of the present invention to provide a seat which is inexpensive to manufacture but also provides the ability to add customized or premium design features while retaining the same basic chair structure.

It is a further object to provide an injection molded seat/back which can have rigid shells added while not detracting from comfort.

It is a further object to provide a chair which can achieve a relatively small envelope.

Herein, the terms "inner" and "outer" are used to refer to particular surfaces/areas of the seat or back or their respective cushions. The inner surfaces of the seat/back would be the ones that the user puts weight on when sitting, i.e. the upper surface of the seat or the forward surface of the backrest, as applicable. The outer surface would be those that the user does not actually sit/rest directly on, i.e. the lower surface of the seat or the rear surface of the backrest, as applicable. As described herein in certain instances, the foam cushion's outer surface is not necessarily the outermost surface and is not necessarily visible, but rather faces the rigid plate's inner surface and in some embodiments the arrangement allows for the foam cushion to deflect within this space. Thus, these terms are used in context in that an "outer" surface might refer to a rear surface or a lower surface, depending on the configuration.

These and other objects are achieved by providing a support frame with thin or flexible supports extending across that frame. A foam cushion is provided and the support frame and thin/flexible supports are molded in the cushion. A rigid panel is attached to the support frame/cushion and provides a cavity with space therein allowing the bottom of the foam cushion to deflect into that space without interference from the rigid panel.

In one aspect a chair is provided comprising at least one support. Each support includes a support frame, a flexible support structure extending across at least a portion of said support frame, a foam cushion wherein substantially all of said support frame and said flexible support structure are molded within said foam cushion and a rigid panel arranged adjacent an outer surface of said foam cushion, wherein said rigid panel is affixed to said support frame and an inner surface of said rigid panel is spaced away from the outer surface of said foam cushion to allow said foam cushion to deflect within a space between said inner surface and said outer surface.

In certain aspects said rigid panel is made from an injection molded polymer. In certain aspects the rigid panel includes wood. In other aspects the wood is a veneer affixed to an injection molded polymeric part and the veneer is positioned on the bottom of the rigid panel. In yet other aspects the at least one support comprises two supports, a first one of the two supports being a seat and a second one of the two supports being a backrest. In other aspects. In yet another aspect, the support frame defines a perimeter and comprises metal tubes and a polymer connector holding the metal tubes in a spaced arrangement to define at least part of the support frame. In other aspects the rigid panel includes one or more protrusions extending from the inner surface towards the lower surface, each protrusion configured to receive a fastener which creates a larger protrusion. In still other aspects the fastener is configured to interact with a narrowing slot in the support frame to affix said rigid panel to said support frame, particularly the screw head will be retained in the narrower side of the narrowing slot when slid into place. In yet other aspects the foam cushion is upholstered and the fastener secures to the narrowing slot through a hole in an outer surface of the upholstery in the foam cushion and the foam cushion provided without a hole adjacent to the fastener in the inner surface of the foam cushion.

Other objects are achieved by providing a chair comprising a frame, a seat and a backrest, the seat and backrest supported by the frame. The seat includes a seat support frame attached to the frame; a seat support structure extending across at least a portion of said seat support frame; a foam cushion wherein substantially all of said seat support frame and said seat support structure are molded within said foam cushion; and a rigid panel arranged adjacent an outer surface of said foam cushion, wherein said rigid panel is affixed to said seat support frame and an inner surface of said rigid panel is spaced away from the outer surface of said foam cushion to allow said foam cushion to deflect within a space between said inner surface and said outer surface. The backrest includes a backrest support frame attached to the frame, the backrest support frame is molded within a backrest foam cushion. A backrest rigid panel having a cavity wherein at least part of said backrest foam cushion is positioned within the cavity of the backrest rigid panel.

In some aspects a wood veneer is secured adjacent to an outer surface of the rigid panel. In other aspects a wood veneer secured adjacent to an outer surface of the backrest rigid panel. In other aspects the seat is pivotable relative to the frame. In other aspects a rotation mechanism is attached to the frame and includes a pin which extends through a hole in the rigid panel.

Yet other objects are achieved by providing a chair which includes a seat support frame and a seat support structure extending across at least a portion of said support frame. A foam cushion and substantially all of said support frame and said support structure are molded within said foam cushion. A rigid panel has a cavity and the rigid panel arranged adjacent an outer surface of said foam cushion with at least part of said foam cushion positioned within the cavity, wherein said rigid panel is affixed to said support frame and an inner surface of said rigid panel faces the outer surface of said foam cushion.

In certain aspects a decorative panel is positioned at least partially within a second cavity in the rigid panel. In other aspects the second cavity is positioned at an outer surface of rigid panel. In other aspects the support frame defines a perimeter and comprises metal tubes and a polymer connector holding the metal tubes in a spaced arrangement to define at least part of the support frame. In still other aspects the rigid panel includes one or more protrusions extending from the inner surface towards the lower surface, each protrusion configured to receive a fastener which secures to the polymer connector.

Other objects are achieved by providing a chair including a seat support frame comprised of at least two tubes spaced apart by a polymer connector, the seat support frame supporting a foam cushion. A rigid panel has a cavity and the rigid panel is arranged adjacent an outer surface of said foam cushion with at least part of said foam cushion positioned within the cavity, wherein said rigid panel is affixed to said support frame and an inner surface of said rigid panel faces the outer surface of said foam cushion.

Other objects are achieved by providing a chair with at least one support, each support includes a support frame including at least one narrowing slot and a foam cushion attached to said support frame and including a lower surface. A rigid panel is arranged adjacent an outer surface of said foam cushion, wherein said rigid panel is affixed to said support frame, said rigid panel includes an inner surface and said rigid panel includes one or more protrusions extending from the inner surface towards the lower surface. The protrusion is configured to interact with the at least one narrowing slot in the support frame to affix said rigid panel to said support frame without the fastener being accessible from a top surface of the cushion.

In certain aspects the protrusion includes a fastener and part of the protrusion is integrally molded in the rigid panel. In other aspects the inner surface of said rigid panel is spaced away from the outer surface of said foam cushion to allow said foam cushion to deflect within a space between said inner surface and said outer surface. In still other aspects a flexible support structure extends across at least part of said support frame and wherein the support frame and flexible support structure are substantially embedded in the foam cushion. In still other aspects the narrowing slot in the support frame is provided in a metal part which is part of the support frame and wherein the support frame is a seat support frame.

Other objects are achieved by providing a chair including a seat support frame and a foam cushion supported by the seat support frame. A rigid panel has a cavity and the rigid panel arranged adjacent an outer surface of said foam cushion with at least part of said foam cushion positioned within the cavity, wherein said rigid panel is affixed to said support frame and an inner surface of said rigid panel faces the outer surface of said foam cushion.

In one aspect the foam cushion is upholstered and the fastener secures to the narrowing slot through a hole in the foam cushion and the foam cushion provided without a hole adjacent to the fastener in the inner surface of the foam cushion and without a hole adjacent to the fastener in the upholstery.

Other objects are achieved by providing a chair including a frame, a seat and a backrest, the seat and backrest supported by the frame. The seat includes a seat support frame attached to the frame; a seat support structure extending across at least a portion of said seat support frame; and a foam cushion. A rigid panel is arranged adjacent an outer surface of said foam cushion, wherein said rigid panel is affixed to said seat support frame with a portion of the seat within a cavity of said rigid panel. The backrest includes a backrest support frame attached to the frame, the backrest support frame including a backrest foam cushion. A backrest rigid panel has a cavity and at least part of said backrest is positioned within the cavity of the backrest rigid panel.

Other objects are achieved by providing a chair including a seat support frame comprised of at least two tubes spaced apart by a connector, the seat support frame supporting a foam cushion. A rigid panel has protrusions which fit into narrowing passages in the connector from a lower side of the foam cushion to secure the rigid panel to the seat support frame such that the fasteners are not accessible from an upper side of the foam cushion.

In one aspect a cavity in the rigid panel is provided and the rigid panel is arranged adjacent an outer surface of said foam cushion with at least part of said foam cushion positioned within the cavity. The rigid panel is affixed to said support frame and an inner surface of said rigid panel faces the outer surface of said foam cushion. In other aspects the protrusions fit into the narrowing passages at a wider end of the narrowing passages and are retained within the narrowing passages when the protrusions are positioned at a narrower end of the narrowing passages.

Other objects of the invention and its particular features and advantages will become more apparent from consideration of the following drawings and accompanying detailed description.

DETAILED DESCRIPTION OF THE INVENTION

Figure 2:
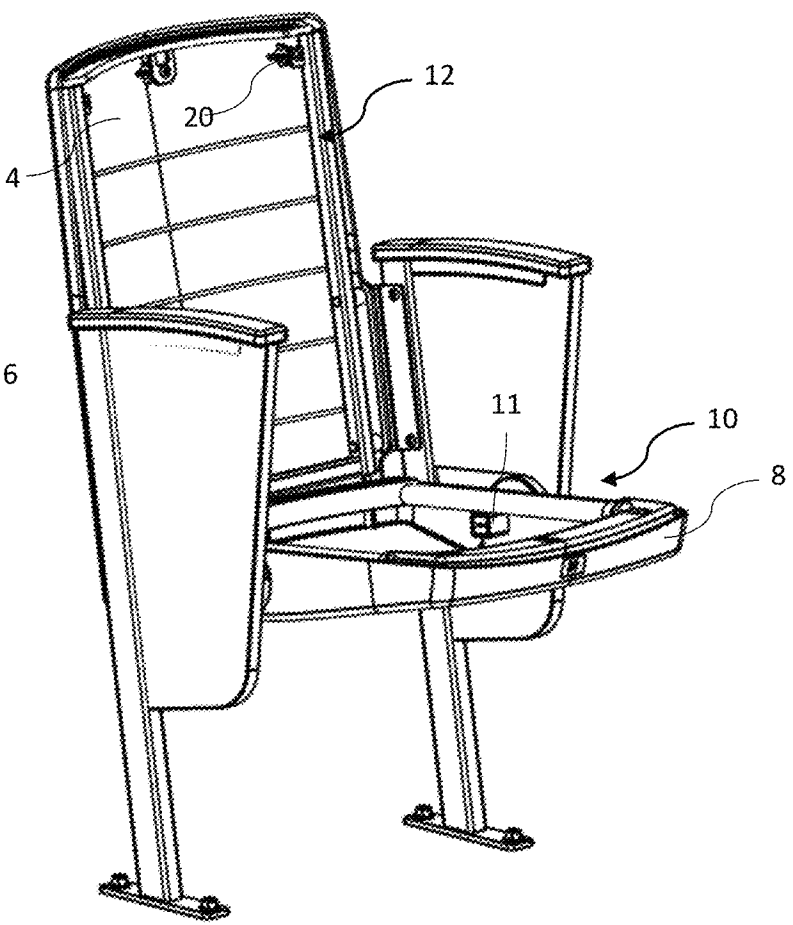
FIG. 2 is a perspective view of FIG. 1 with the foam/upholstery removed.

Referring now to the drawings, wherein like reference numerals designate corresponding structure throughout the views. The following examples are presented to further illustrate and explain the present invention and should not be taken as limiting in any regard.

Figure 1:
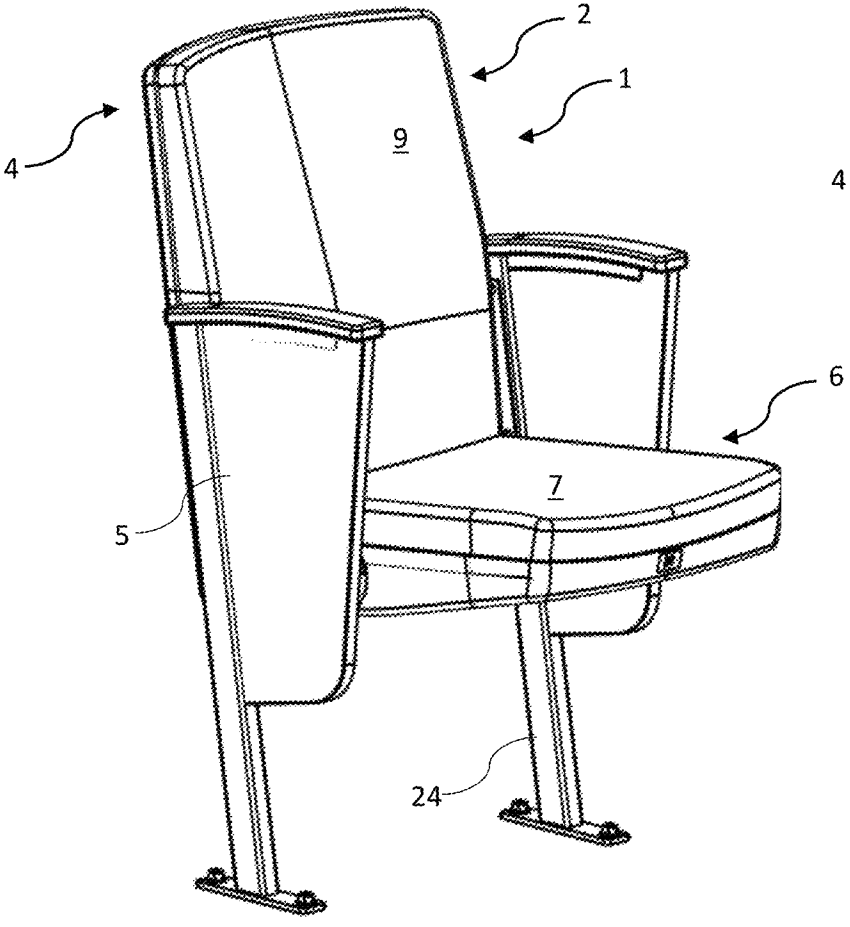
FIG. 1 is a perspective view of a chair according to the present invention.
Figure 4:
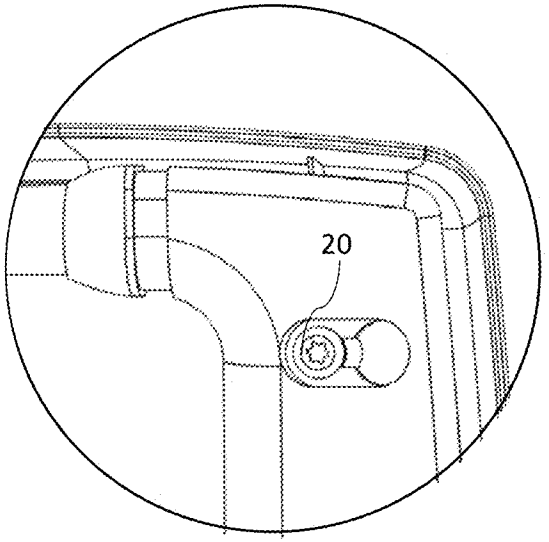
FIG. 4 is a detail view of FIG. 3.

A chair according to the present invention is shown in FIG. 1 an the following figures. The chair 1 includes a seat 6, a backrest 4 and a frame including e.g. frame pieces 34/36 with legs 24 that bolt to a floor/riser or other fixed structure. The back cushion 9 and the seat cushion 7 are upholstered foam and optional side panels 5 can be provided, depending on the aesthetic requirements. FIG. 2 shows the chair of FIG. 1 but with the cushions 7/9 removed so that the interior support structure can be seen. The back support 12 provides a metal frame which is molded over in foam. The seat frame 10 is also molded over in foam with both the seat and backrest being further upholstered. Rigid panel 8 is provided to secure to the seat and the seat frame 10 to provide added protection and durability along with the desired aesthetic.

Figure 3:
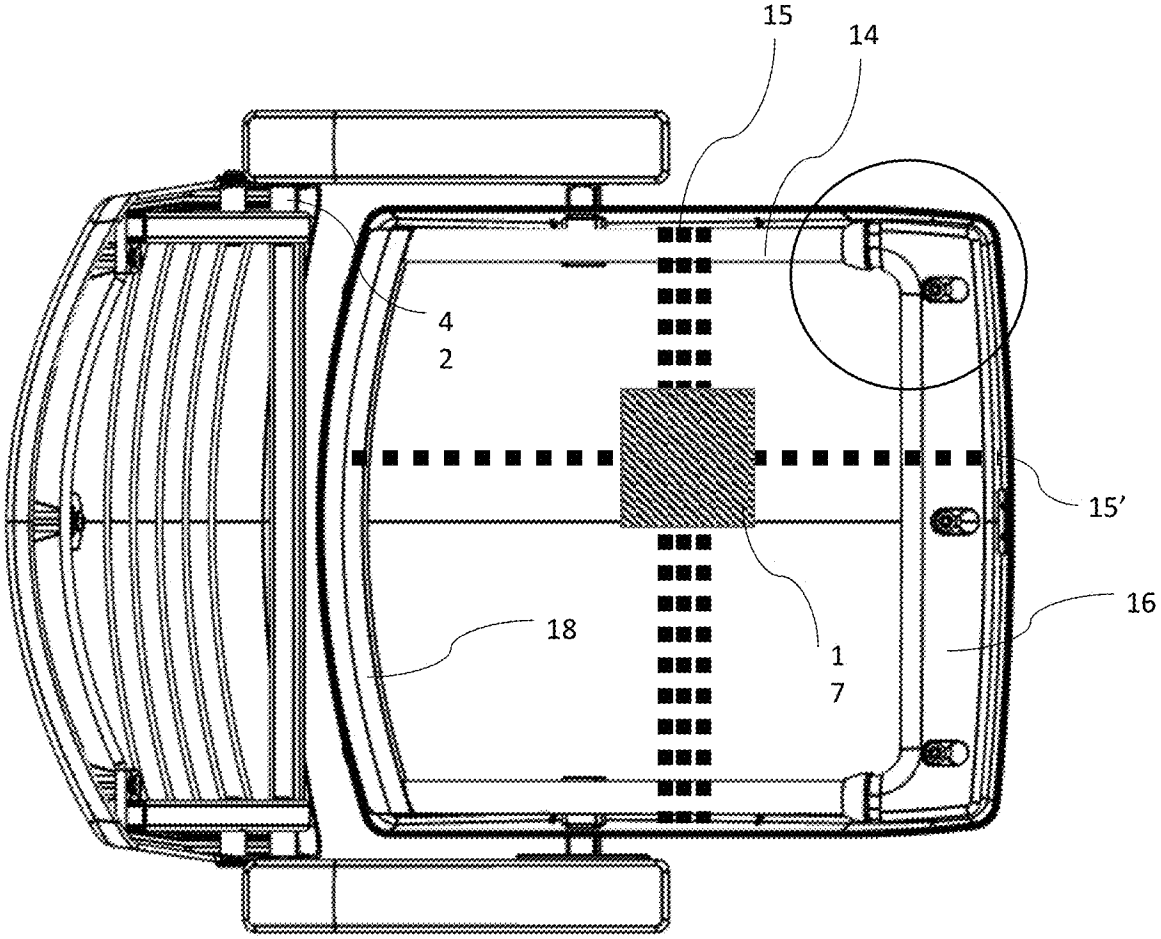
FIG. 3 is a top view of FIG. 2.
Figure 15:
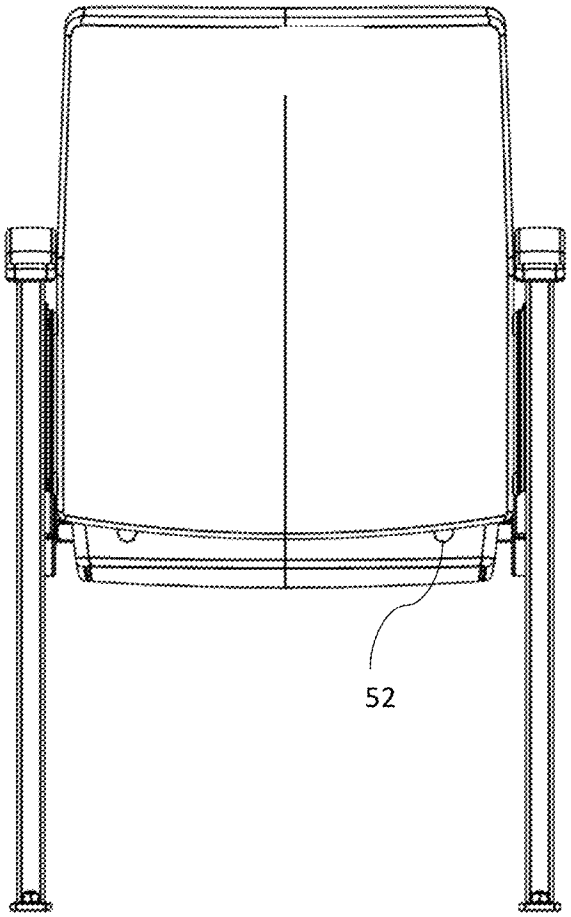
FIG. 15 is a rear view of the chair of FIG. 1 in the upholstered back configuration.

FIG. 3 depicts the webbing 15 which wraps around metal frame parts 14 across the seat. The webbing may also weave in with front to back webbing 15'. It is understood that only some of the webbing is shown to avoid drawing clutter. This arrangement can also be used for the backrest. Additional details on the webbing and arrangement of the surround foam is shown and described in U.S. Pat. No. 7,690,732, the contents of which are incorporated by reference herein. The front of the frame 10 includes a polymeric part 16 which is preferably injection molded and secured with fasteners 20 to the rigid panel 8. These fasteners insert into narrowing openings in that a hole can be cut in the bottom of the foam/upholstery of the seat and the fasteners inserted into the larger holes shown and then slid down into position into the narrowed section. As a result, the fastener head is retained in position but is not accessible from the upper surface of the seat or from the inner surface of the backrest (the upper and inner surfaces here referring to those the user would sit on). In this manner, the rigid panel can be secured to the seat in a discrete way such that the fasteners are not visible or may be considered blind fasteners. In certain aspects, the foam may be molded with a lower void where the narrowing openings are located, for example cylinder/oval shaped protrusions may extend from the bottom of the mold to contact the plates 2002 or the holes 52 in order to inhibit foam from closing these areas. As a result, the protrusion of the bottom rigid panel can insert into that void easily, particularly the screw which may be considered part of the protrusion. The upholstery cover may be designed to overlap the lower perimeter of the seat by a small amount such as 0.5 to 1 inches, thus leaving this void accessible to the screw for securing the rigid panel to the bottom. A similar structure can be employed for the backrest and the corresponding narrowing openings. Further support of the rigid panel may be provided by the pin/pin support of the rotation mechanism inserting through a hole in the rigid panel located at the rotation axis of the seat. As shown in FIG. 15, fasteners and a plug covering the fastener can be used on the rear of the panel 8 to secure the panel to the rear support 18 of the seat frame. FIG. 3 further depicts foam 17 which molds over the webbing 15/15'. Since the foam and webbing or other flexible support provide both adequate support and cushion, the seat can be thinner than slab foam seats. However, the comfort of this design may sometimes rely on the ability for the lower surface of the seat to deflect down. Slab foam arrangements generally prevent this movement as a rigid wood support would not allow such deflection. In the arrangement shown, the seat cushion is relatively thin compared to the space provided by the rigid panel 8 and as a result, there is free space between the lower/outer surface of the foam cushion and the upper/inner surface of the rigid panel 8. This is free space is generally in the area of the two sided black arrow 600 in FIG. 6A. As a result of this free space, when the user sits on the seat, the lower surface of the foam cushion deflects downwards and is not restricted by the rigid panel. Thus the comfort and softness of the seat is controlled by the flexible support/webbing and the foam while still giving the look of a rigid lower panel of the seat. As can be seen, some or all of the foam cushion may rest inside the cavity defined by the interior of the rigid panel 8.

Figure 6:
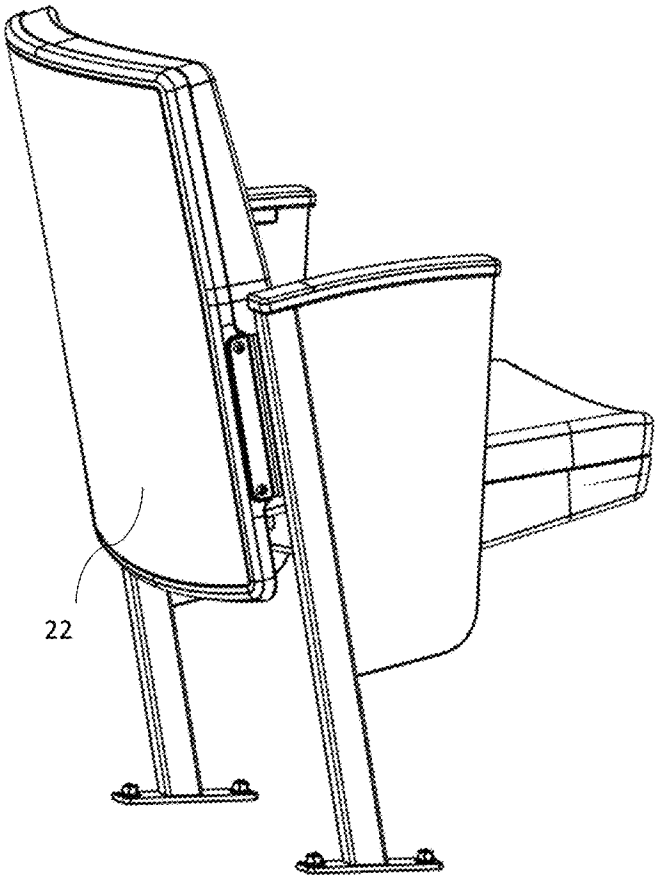
FIG. 6 is a rear perspective view of FIG. 1.
Figure 5:
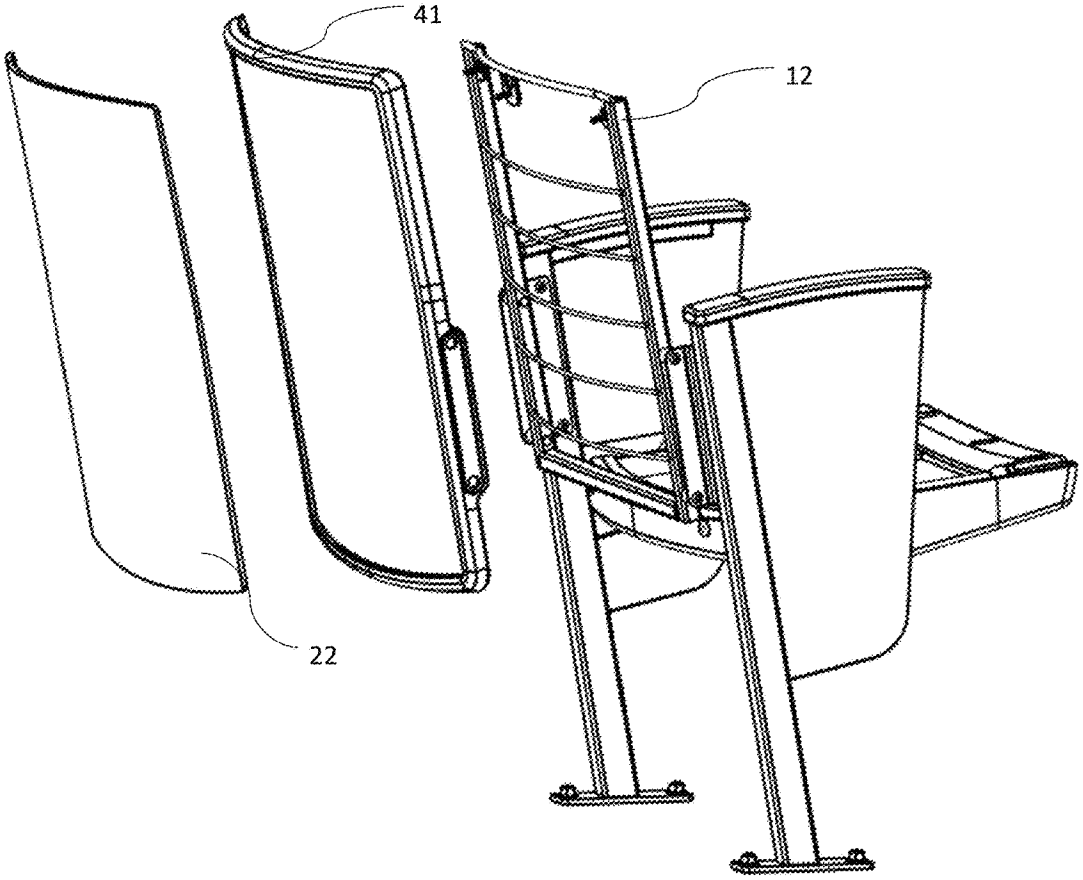
FIG. 5 is an exploded view of FIG. 2.
Figure 6A:
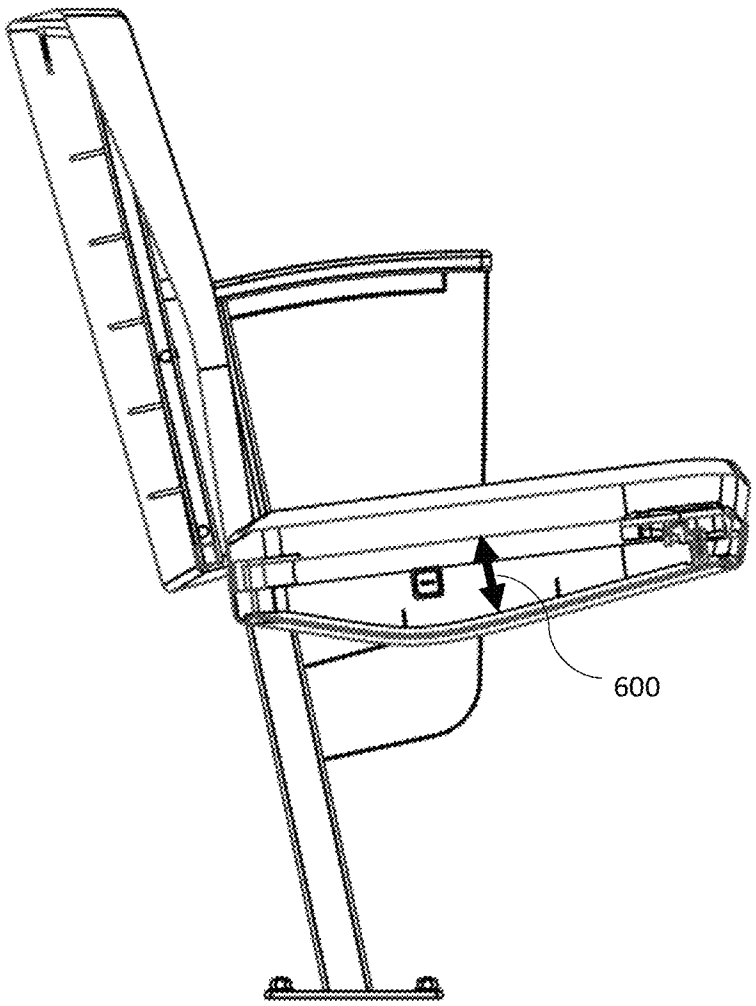
FIG. 6A is a section view of FIG. 1 through the middle of the chair.
Figure 5A:
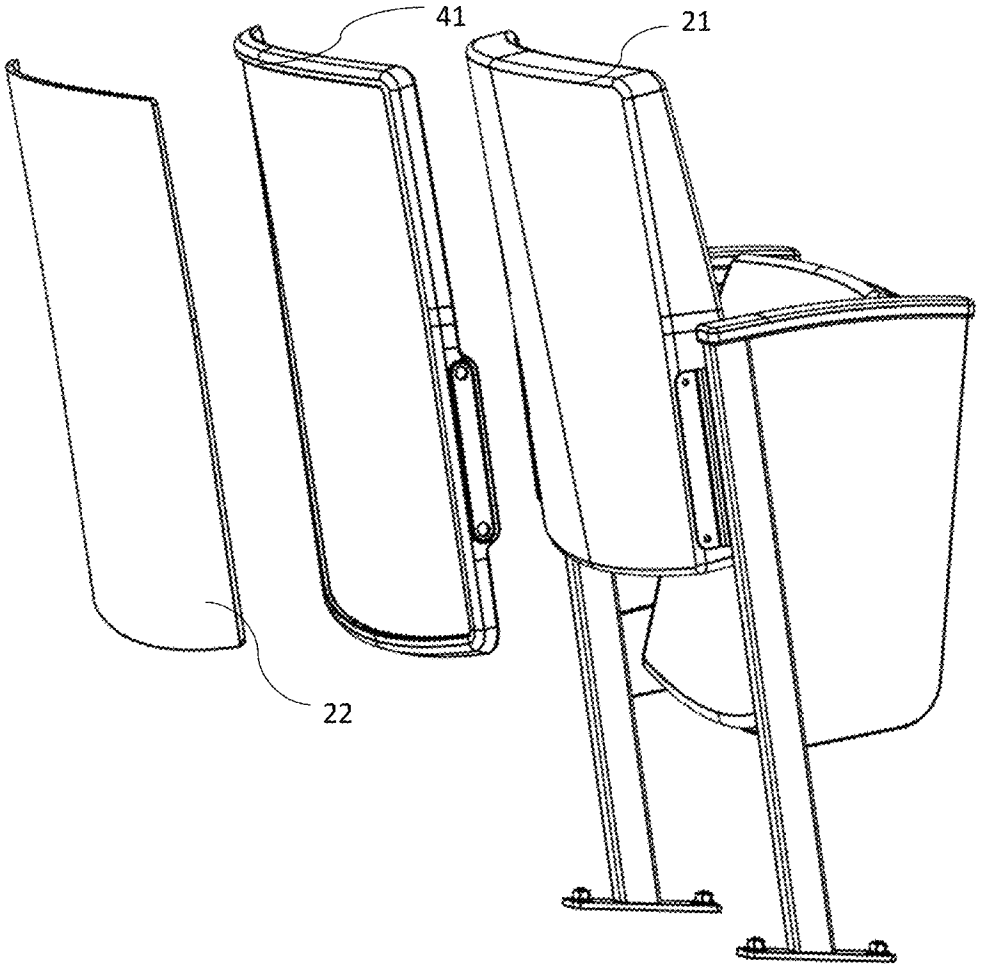
FIG. 5A is a rear perspective exploded view of FIG. 1.

Referring to FIG. 5, the rear of the seat is shown in exploded view with the cushion removed. The plastic panel 4 is provided with an outer or rear cavity that decorative panel 22 fits into. Typically glue will be used for securing. Although the fasteners 20 are shown connected to the frame 12, it is understood that when assembling, typically the fasteners 20 will be threaded into the posts/protrusions 32, a hole cut in the rear upholstery and the fasteners inserted. As seen in FIG. 6, the decorative panel rests in the rear cavity of the rigid panel 41 of the back. This decorative panel may be e.g. wood veneer, wood look materials or a printed/sublimated/hydro dipped panel. Other manners of decorating the panel can be used. Due to the decorative panel 22 sitting within the rear cavity of the rigid panel 41, the edges of the decorative panel 22 are protected. This is particularly useful for wood, plywood and especially thin materials as the edges could otherwise become damaged. The normal solution to the problem of providing a wood panel on the back and solving for edge damage is to use a relatively thick sheet of wood/plywood. However, this is more expensive and carries with it the downsides of slab foam previously described. It is also contemplated that the panels 41/22 can be not be used in the chair, depending on what design is preferable. In this manner, all the same parts used for constructing the chair can be used, just the panels 41/22 are removed and the upholstered back is then visible. This allows for multiple different aesthetic options for the chair without requiring separate inventory for upholstered back surface, plastic back surface or wood back surface options. This increases flexibility for the customer but limits inventory/cost for the manufacturer. FIG. 5A shows how the panels 41/22 can both be used, just panel 41 or no panels can be used without different inventory of parts. If the panels 41/22 are not used, the foam cushion 21, specifically its upholstered rear side would be visible.

Figure 8:
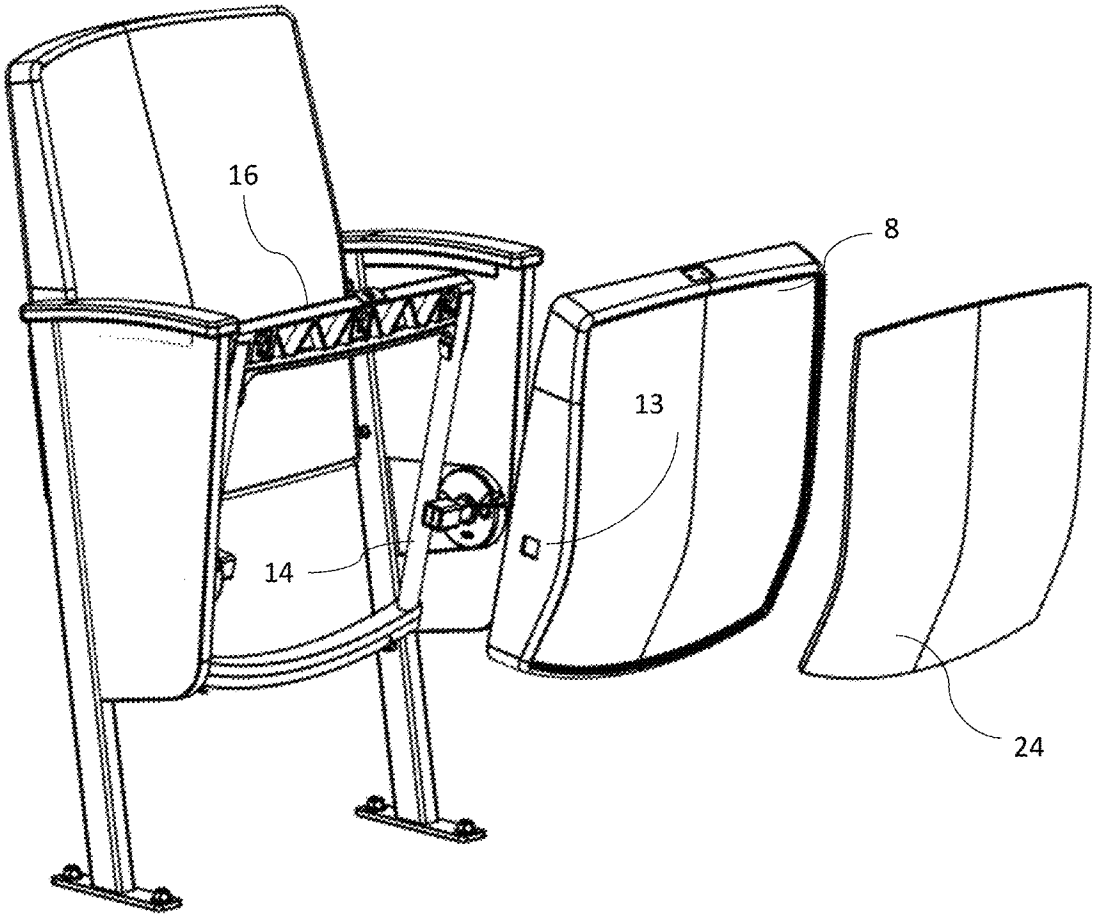
FIG. 8 a front perspective view of FIG. 7.
Figure 7:
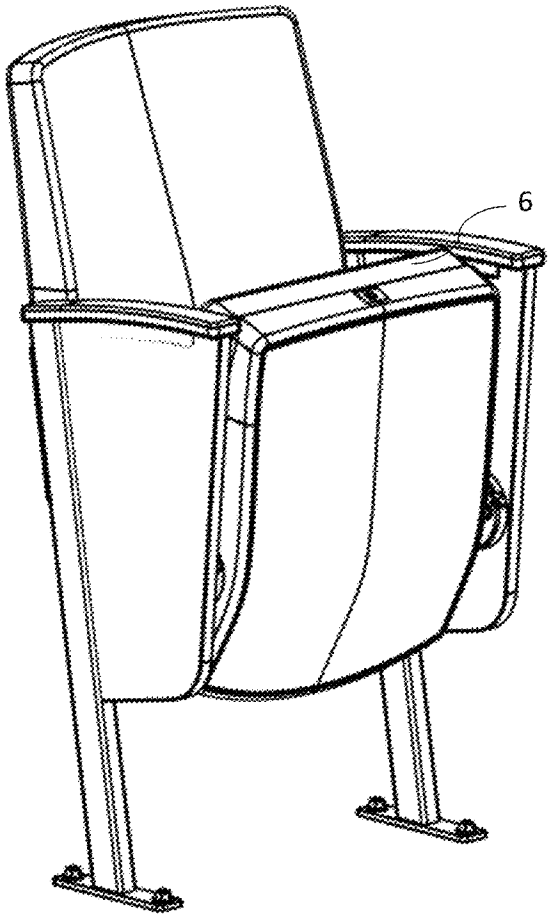
FIG. 7 is a front perspective view of FIG. 1 with the seat in the up position.

FIGS. 7 and 8 show a similar assembly process for the back as compared to FIGS. 5 and 6 as the back. Specifically, the foam is not shown on the seat and polymer part 16 can be seen (and in further detail in FIG. 10). The rigid panel 8 includes a cavity on the inside for the foam seat to sit in along with an outer cavity that the decorative panel 24 can sit in (typically glued in). The pin/pin support can extend into hole 13 to further secure the panel 8 and the fasteners in the protrusions of the rigid panel 8 secure to the plastic support part 16.

Figure 10:
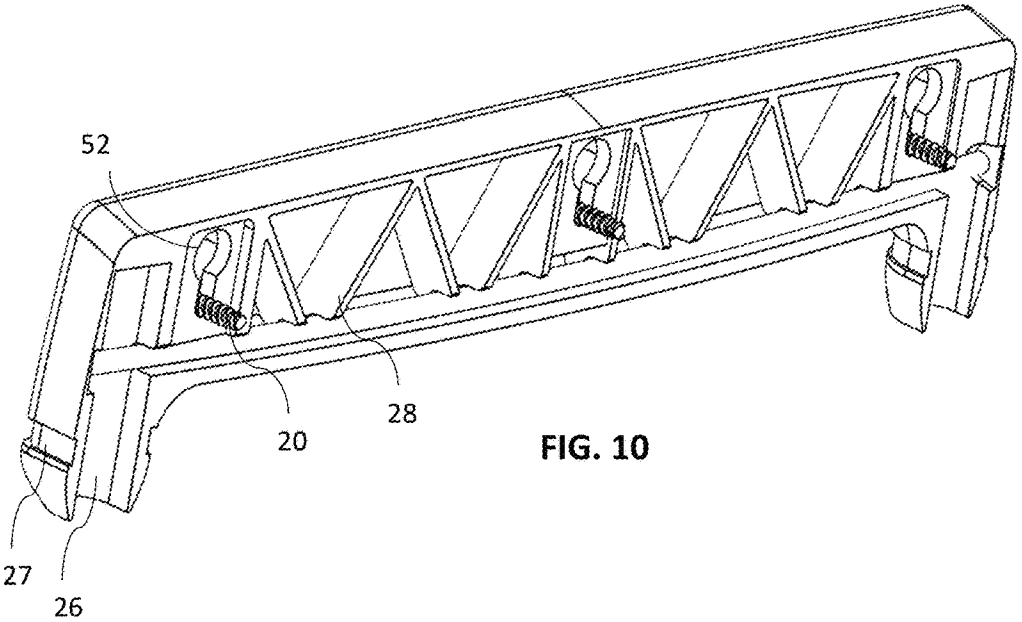
FIG. 10 is a perspective view of another component of the chair of FIG. 1
Figure 9:
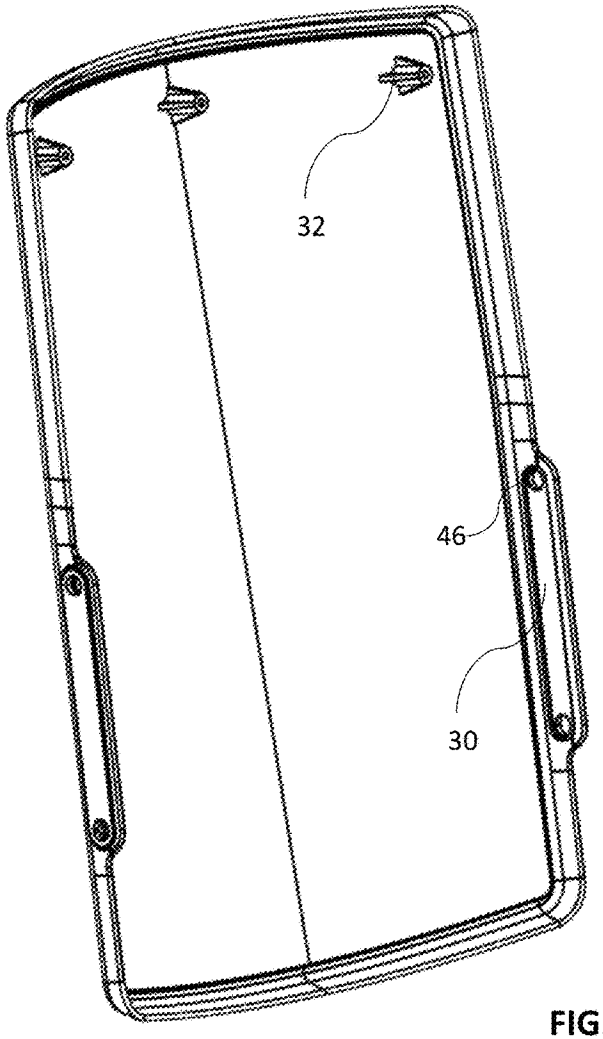
FIG. 9 is a perspective view of a component of the chair in FIG. 1
Figure 13:
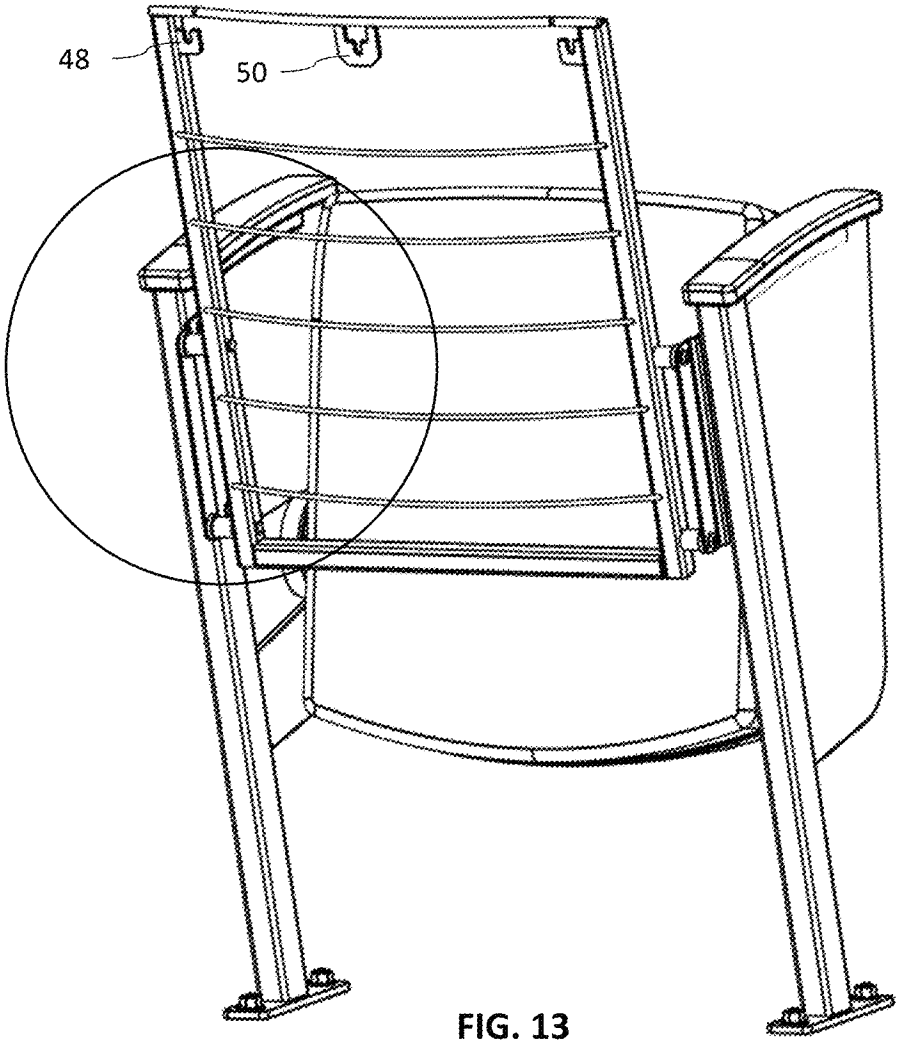
FIG. 13 is a rear perspective view of the chair of FIG. 1 with decorative pieces and foam removed from the back.
Figure 14:
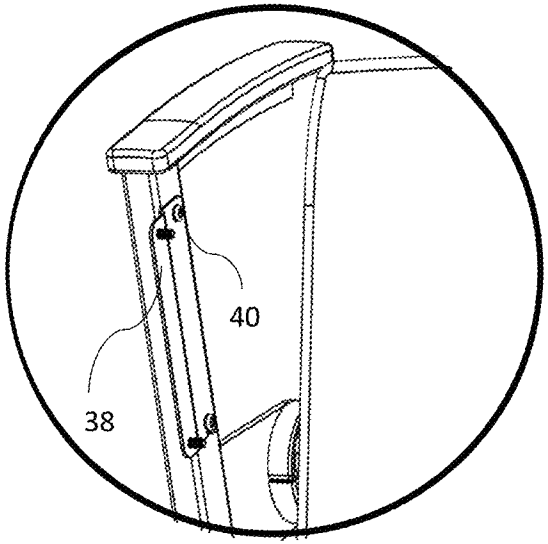
FIG. 14 is a detail view of FIG. 13.

FIG. 9 depicts the rear panel 41. Protrusions 32 extend from the inner surface into the inner cavity. These protrusions 32 would also be provided on the bottom rigid panel 8. The rear panel in FIG. 9 includes a wing area 30 which allows for securing to plate 38 (FIG. 14). The holes 46 allow the same bolt/bushing/fastener combination to be used regardless of if the rear panel 41 is used or not. FIG. 10 shows the polymeric part with channels 26. These channels are preferably designed to snap over tubes 14 to create the seat frame. Channels 27 may be provided for e.g. bands/band clamps/tie wraps to wrap around the interface between parts 14 and 16 to ensure the seat frame remains assembled under load. The holes 52 are provided with narrowing openings to retain the fastener head 20 and allow for insertion and then sliding to secure. The polymeric part 16 is provided with supporting rib 28 structures to allow for adequate rigidity without requiring a solid piece of plastic in the front. The seat support design provides a structure that can be assembled with less welding and/or tube bending or without welding and/or tube bending, thus requiring less skilled labor to create the seat support. This allows for reduced cost of manufacture while maintaining overall quality.

Figure 12:
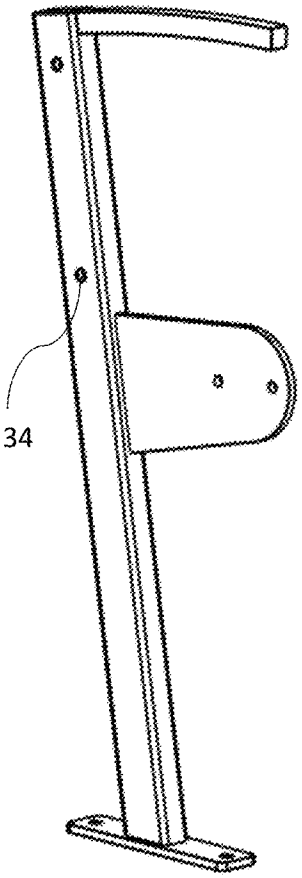
FIG. 12 is a perspective view of the left support of the chair of FIG. 1.
Figure 11:
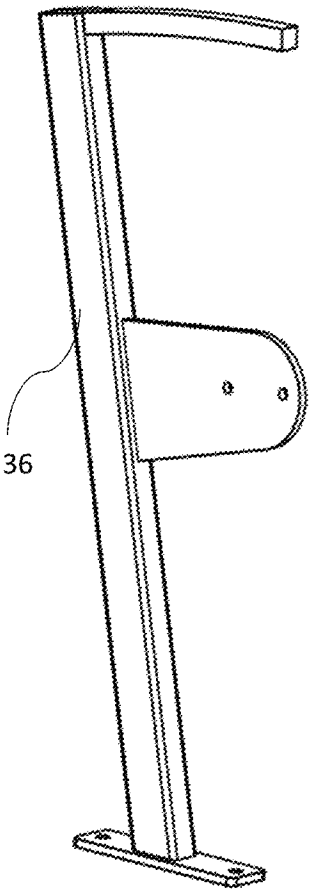
FIG. 11 is a perspective view of the right support of the chair of FIG. 1.

FIGS. 11 and 12 show the left and right components of the frame. As can be seen, the outer surface 36 is provided without holes, but holes 34 are seen on the inner surface. When the back frame 12 is assembled via plate 38, rivets 40 can feed into and are secured to this hole 34. The result is that the rear of the seat frame does not have visible fasteners on the upper side. The back frame is also provided with tabs including narrowing openings or catches to hold the fastener head in position. As stated earlier, the fasteners can be inserted through holes cut in the rear of the foam/upholstery of the seat/back to attach panels 8/41 as the case may be.

Figure 16:
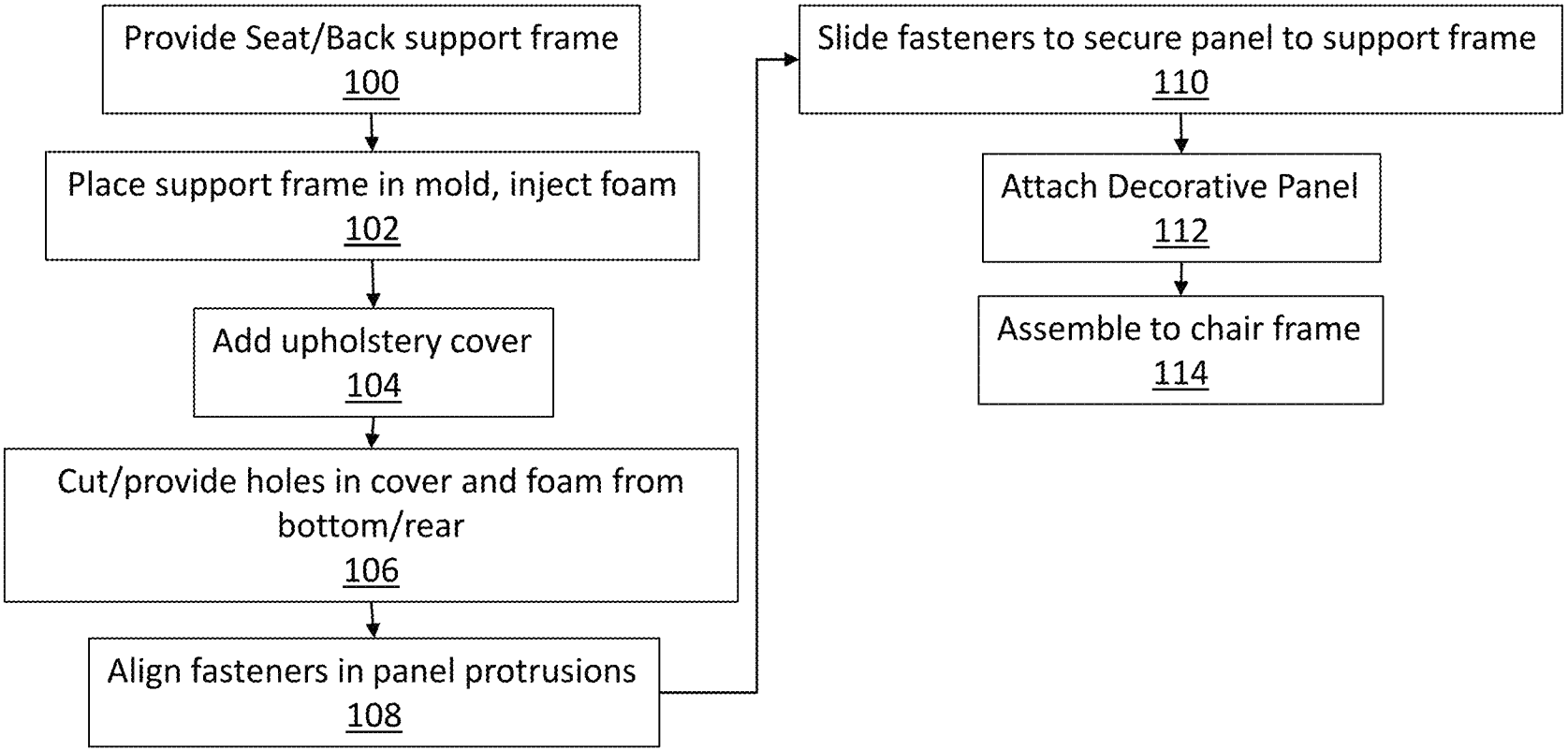
FIG. 16 shows an assembly process for the chair.
Figure 18:
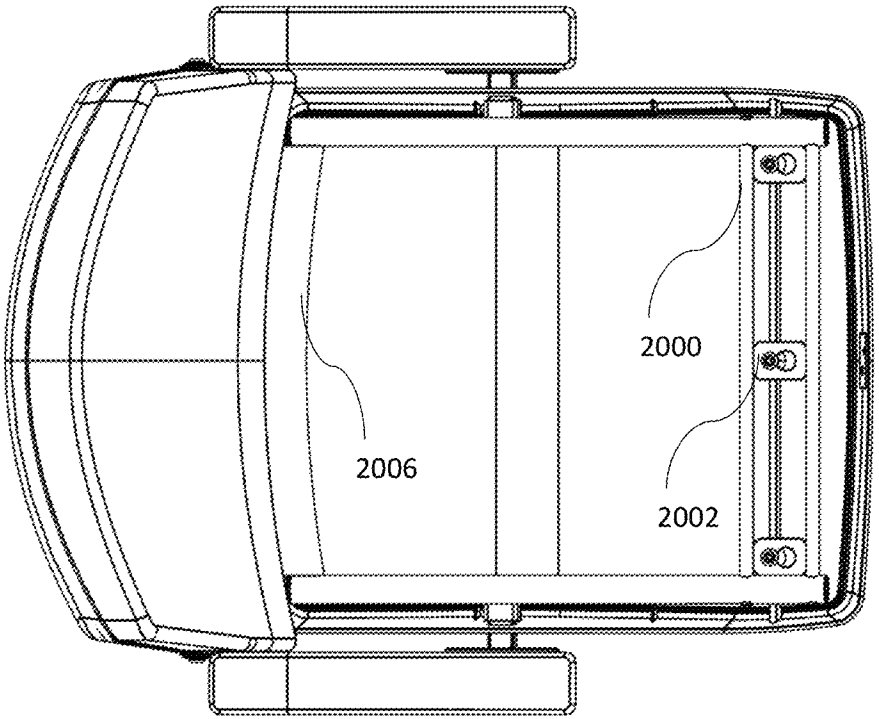
FIG. 18 shows a top view of FIG. 17.
Figure 17:
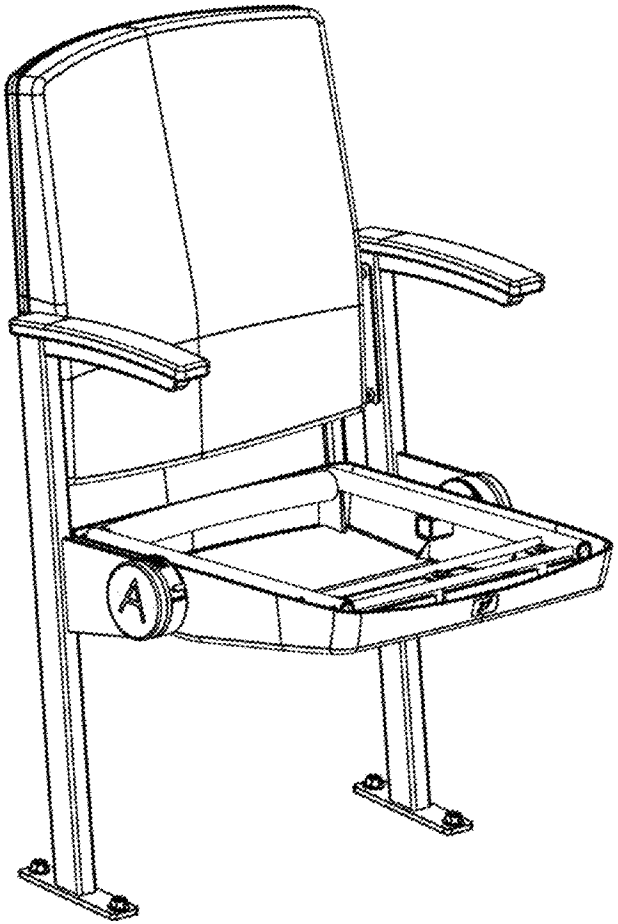
FIG. 17 shows a perspective view of an embodiment of the chair according to the present invention with the seat cushion removed.
Figure 20:
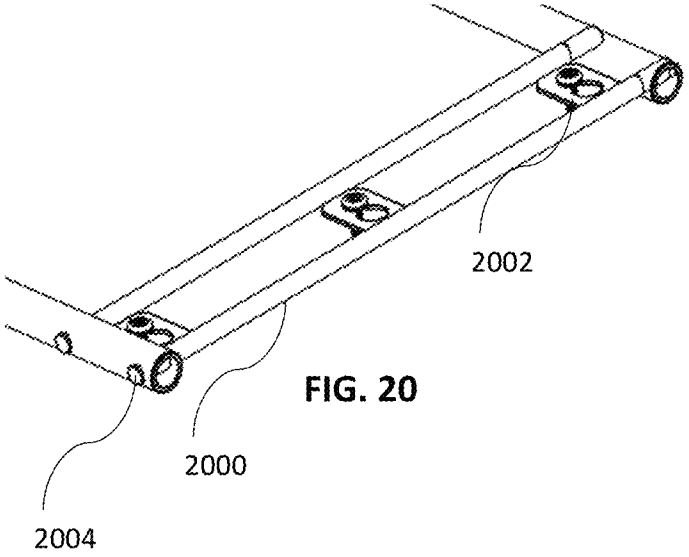
FIG. 20 shows a detail perspective view of the seat bottom support structure of FIG. 17.

FIG. 16 shows an exemplary process by which the chair may be manufactured. As shown, the seat/back support frame(s) are provided 100. These frames are placed in the mold and foam is injected 102. The support frames may include flexible supports extending across the frame perimeters or more rigid supports and these become substantially surrounded/embedded in the foam. It is understood that some portions may not be fully embedded as a result of the injection molding, but the overwhelming majority will be incased in foam. The molded frames are then removed and upholstery covers added 104. Holes are cut in the cover and foam 106 near the protrusions where the fasteners 20 secure. Alternately, the molding process may include protrusions which extend into the mold to inhibit foam from covering the narrowing holes/catches the fasteners 20 interact with. These protrusions would extend from the rear surface to the height within the mold of these narrowing holes/catches. With these cut holes/provided holes, the fasteners can be aligned 108 and slid to secure the rigid panel 8/41 to the respective support frame 110. Optionally, the decorative panel is attached 112, e.g. by gluing and the seat and back are assembled to the support frame. The seat may be assembled on site via a drop-in rotation mechanism or other rotation mechanism. The back may also be assembled to the frame on site. The rigid panel described herein is preferably made of thin injection molded plastic, thus the thin nature of the design may make it somewhat flexible, but the part would still be considered rigid because when secured to the support frame, twisting becomes less prevalent and a relatively hard surface is provided by the rigid panel in comparison to the softer foam cushion. The rigidity may, for example, be considered to be provided by the material used, e.g. HDPE, LDPE, Nylon or other polymeric/polymeric composite materials of relatively higher durometers.

Figure 19:
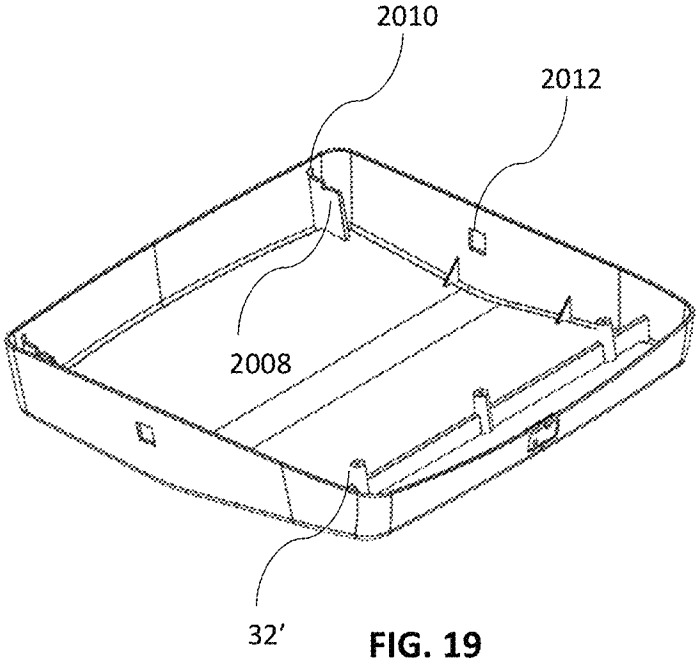
FIG. 19 shows a perspective view of a component of the seat bottom of FIG. 17.

Referring to FIGS. 17-20 an alternate arrangement of the seat bottom support and panel is depicted. The seat bottom uses the same cushion structure having the flexible webbing and surround/injection molded foam as in prior designs discussed herein. The seat frame includes a different front assembly and rear assembly. The rear assembly is a thicker tube 2006 which provides a counter weight for the gravity lift seat. The front assembly is shown as two bars 2000 with plates 2002 welded at spaced locations between the tubes. These plates 2002 include the same narrowing opening used to attach the seat bottom/back in other embodiments. The bars 2000 are optionally bolted or riveted 2004 to the side support tubes. The front bar/plate assembly replaces the polymeric part depicted in FIG. 10 in the embodiment shown. The decorative panel shown in FIG. 19 is preferably injection molded like the others shown and described herein. The panel includes posts/protrusions 32' that have holes therein to receive fasteners to secure the panel to the seat bottom as in other embodiments of the decorative panels shown and described herein. The protrusion may be considered to include the fastener (screw) as part thereof. The screw can be adjusted to ensure the screw head fits into the narrowing opening provided by the seat.

A rear protrusion 2008 is also molded to the panel at the back and adjacent to screw hole 2010. In this manner, positive engagement with the rear of the seat can be made between the plastic of the panel and the seat. Through hole 2012 receives the pin for the connection/tilt mechanism which is used to allow the seat to pivot/rotate and also provides further securing of the decorative panel to the seat cushion. In this manner, if the panel is bumped or kicked, that force will largely be supported by the rear protrusions 2008 as opposed to creating shear forces on the screw passing through the screw hole 2010 and securing to the rear of the frame. The decorative panel shown in FIG. 19 also includes the appropriate cavity/space as found in other embodiments described herein. This allows the cushion to deflect when sat on and preferably a lower perimeter of the seat sits at least partially within the cavity with the cushioned portion of the seat protruding from the top of the panel. The panel can include the outer recess for receiving the decorative plate, for example wood veneer.

Although the invention has been described with reference to a particular arrangement of parts, features and the like, these are not intended to exhaust all possible arrangements or features, and indeed many other modifications and variations will be ascertainable to those of skill in the art.

What is claimed is:

1. A chair comprising at least one support, each support comprising:

a support frame including at least one narrowing slot;

a foam cushion attached to said support frame and including a lower surface;

a rigid panel arranged adjacent an outer surface of said foam cushion, wherein said rigid panel is affixed to said support frame, said rigid panel includes an inner surface and said rigid panel includes at least one protrusion extending from the inner surface towards the lower surface;

the at least one protrusion is configured to interact with the at least one narrowing slot in the support frame to affix said rigid panel to said support frame without the at least one protrusion being accessible from a top surface of the cushion.

2. The chair of claim 1 wherein said rigid panel comprises an injection molded polymer.

3. The chair of claim 2 wherein the wood is a veneer affixed to the rigid panel which is an injection molded polymeric part and the veneer is positioned on the bottom of the rigid panel.

4. The chair of claim 1 wherein said rigid panel includes wood.

5. The chair of claim 1 wherein the at least one support comprises two supports, a first one of the two supports being a seat and a second one of the two supports being a backrest.

6. The chair of claim 1 wherein the at least one protrusion includes a fastener and part of the protrusion is integrally molded in the rigid panel.

7. The chair of claim 1 wherein the inner surface of said rigid panel is spaced away from the outer surface of said foam cushion to allow said foam cushion to deflect within a space between said inner surface and said outer surface.

8. The chair of claim 1 further comprising a flexible support structure extending across at least part of said support frame and wherein the support frame and flexible support structure are substantially embedded in the foam cushion.

9. The chair of claim 1 wherein the narrowing slot in the support frame is provided in a metal part which is part of the support frame and wherein the support frame is a seat support frame.

10. The chair of claim 1 wherein the foam cushion is upholstered and the fastener secures to the narrowing slot through a hole in the foam cushion and the foam cushion provided without a hole adjacent to the fastener in the inner surface of the foam cushion and without a hole adjacent to the fastener in the upholstery.

11. A chair comprising a frame, a seat and a backrest, the seat and backrest supported by the frame, the seat comprising:

a seat support frame attached to the frame;

a seat support structure extending across at least a portion of said seat support frame;

a foam cushion;

a rigid panel arranged adjacent an outer surface of said foam cushion, wherein said rigid panel is affixed to said seat support frame with a portion of the seat within a cavity of said rigid panel;

the backrest comprising a backrest support frame attached to the frame, the backrest support frame including a backrest foam cushion;

a backrest rigid panel having a cavity wherein at least part of said backrest is positioned within the cavity of the backrest rigid panel.

12. The chair of claim 11 further comprising a wood veneer secured adjacent to an outer surface of the rigid panel.

13. The chair of claim 11 further comprising a wood veneer secured adjacent to an outer surface of the backrest rigid panel.

14. The chair of claim 11 wherein the seat is pivotable relative to the frame.

15. The chair of claim 11 wherein a rotation mechanism is attached to the frame and includes a pin which extends through a hole in the rigid panel.

16. A chair comprising:

a seat support frame;

a foam cushion supported by said seat support frame;

a rigid panel having a cavity and the rigid panel arranged adjacent an outer surface of said foam cushion with at least part of said foam cushion positioned within the cavity, wherein said rigid panel is affixed to said support frame and an inner surface of said rigid panel faces the outer surface of said foam cushion.

17. The chair of claim 16 further comprising a decorative panel, the decorative panel positioned at least partially within a second cavity in the rigid panel.

18. The chair of claim 17 wherein said second cavity is positioned at an outer surface of rigid panel.

19. The chair of claim 16 wherein the support frame defines a perimeter and comprises metal tubes and a polymer connector holding the metal tubes in a spaced arrangement to define at least part of the support frame.

20. The chair of claim 16 wherein the rigid panel includes one or more protrusions extending from the inner surface towards the lower surface, each protrusion configured to receive a fastener which secures to the polymer connector.

21. A chair comprising:

a seat support frame comprised of at least two tubes spaced apart by a connector, the seat support frame supporting a foam cushion;

a rigid panel having protrusions which fit into narrowing passages in the connector from a lower side of the foam cushion to secure the rigid panel to the seat support frame such that the protrusions are not accessible from an upper side of the foam cushion.

22. The chair of claim 21 further comprising a cavity in the rigid panel and the rigid panel arranged adjacent an outer surface of said foam cushion with at least part of said foam cushion positioned within the cavity, wherein said rigid panel is affixed to said support frame and an inner surface of said rigid panel faces the outer surface of said foam cushion.

23. The chair of claim 21 wherein the protrusions fit into the narrowing passages at a wider end of the narrowing passages and are retained within the narrowing passages when the protrusions are positioned at a narrower end of the narrowing passages.

* * * * *